United States Patent [19]

Van Gerpen

[11] 4,202,326

[45] May 13, 1980

[54] MUSCLE MANIPULATING APPARATUS

[76] Inventor: Gary W. Van Gerpen, 833 Eleventh Ave., Helena, Mont. 59601

[21] Appl. No.: 929,923

[22] Filed: Aug. 1, 1978

[51] Int. Cl.[2] ..... A61H 1/00

[52] U.S. Cl. ..... 128/33; 128/52

[58] Field of Search ..... 128/33, 44, 57, 52, 128/51, 56, 242, 24.3

[56] References Cited

U.S. PATENT DOCUMENTS

| | | | |
|---|---|---|---|
| 2,127,132 | 8/1938 | Monroe | 128/57 |
| 2,773,498 | 12/1956 | Himmelman | 128/33 |
| 3,196,868 | 7/1965 | Johnston | 128/57 |
| 3,298,363 | 1/1967 | Parkin | 128/33 |

*Primary Examiner*—Lawrence W. Trapp
*Attorney, Agent, or Firm*—Arthur L. Urban

[57] ABSTRACT

Muscle manipulating apparatus including a frame having a pair of spaced end members disposed substantially parallel to each other, a plurality of crossmembers extending between the end members, the crossmembers being disposed in a parallel relationship adjoining each other to form a substantially continuous surface, each of the crossmembers being supported for movement in a longitudinal plane through the crossmember which is substantially perpendicular to its portion of the surface, means for sequentially moving each of the crossmembers including a rotatable cam shaft positioned behind the crossmembers, the cam shaft being disposed substantially perpendicular to the longitudinal axes of the crossmembers, the cam shaft having a plurality of cam surfaces equal in number to the crossmembers, each of the cam surfaces being disposed adjacent to one of the crossmembers and engageable therewith, and drive means for rotating the cam shaft and the cam surfaces thereon to provide cyclical movement of the crossmembers.

7 Claims, 3 Drawing Figures

MUSCLE MANIPULATING APPARATUS

This invention relates to a novel apparatus for manipulating muscles and more particularly relates to a new apparatus which provides manipulation of muscles automatically.

Massaging and other manipulation of the muscles of the human body have been practiced throughout the ages. If the massaging of the muscles is properly performed, tenseness and strain in the muscles are removed and the muscles relax. While a massage by a skilled masseur or masseuse can be very beneficial, a massage by an untrained person can have the opposite effect. It can increase the tenseness in the muscles and cause new strains to develop. Thus, it is essential that a masseur be experienced and well trained.

To become a skilled masseur requires many hours of instruction and practice. As a result, there are a limited number of good masseurs, even though many individuals have had some training and/or experience and hold themselves out to the public as professional masseurs.

Because of the limited number of skilled masseurs, many people are hesitant to utilize the services of a masseur for fear that they will engage one having a lower degree of skill. Another reason why individuals do not more frequently seek the services of a masseur may be their embarassment at having someone who is only a casual acquaintance touch their bodies. Also, they may be reluctant to spend the time and money to visit a masseur.

A number of alternatives have been proposed to aid in the relaxation of muscles. These include instruction books to guide an untrained person in giving a massage. Also, various mechanical and electrical devices such as vibrators and the like have been proposed. Some of these vibrators are designed to fit on the back of a hand to provide movement to the hand itself. Other vibrators have pads which are placed in contact with the muscle needing treatment. In either case, the results achieved depend to a large extent upon the skill of the person doing the massaging.

The present invention provides a novel apparatus which automatically manipulates muscles without relying on the skill of a person. Furthermore, the apparatus of the invention provides manipulation without the use of hands. In addition, the apparatus of the invention provides manipulation automatically in a proper professionally selected pattern. Also, the apparatus is simple to use with a minimum of instruction by untrained persons. Moreover, the apparatus of the invention does not require the assistance of others so it can be used alone in complete privacy. Also, the apparatus is simple in design and can be fabricated from commercially available components and materials relatively inexpensively.

Other benefits and advantages of the novel apparatus of the present invention will be apparent from the following description and the accompanying drawings in which.

Figure 1:
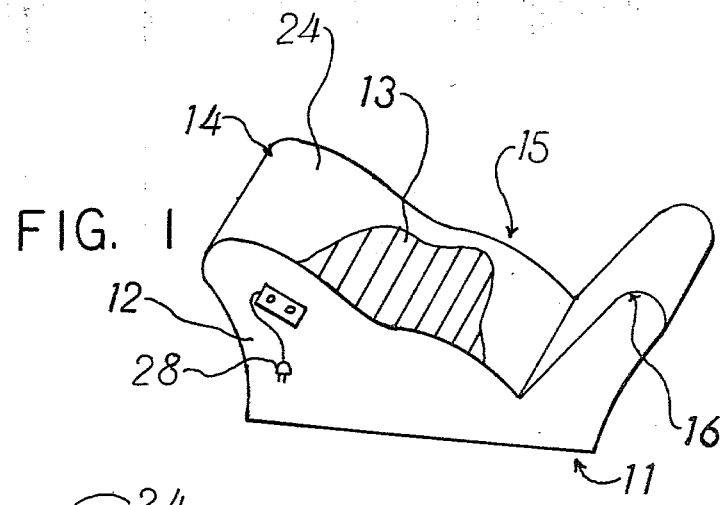
FIG. 1 is a view in perspective of one form of the apparatus of the invention.
Figure 2:
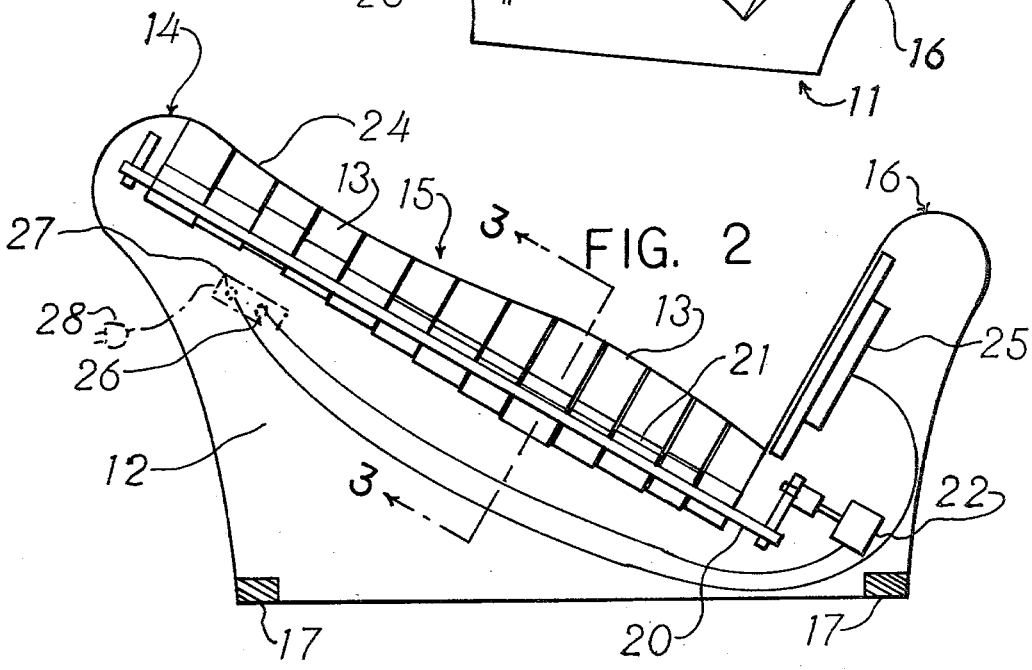
FIG. 2 is an enlarged fragmentary side view partially in section of the apparatus shown in FIG. 1.
Figure 3:
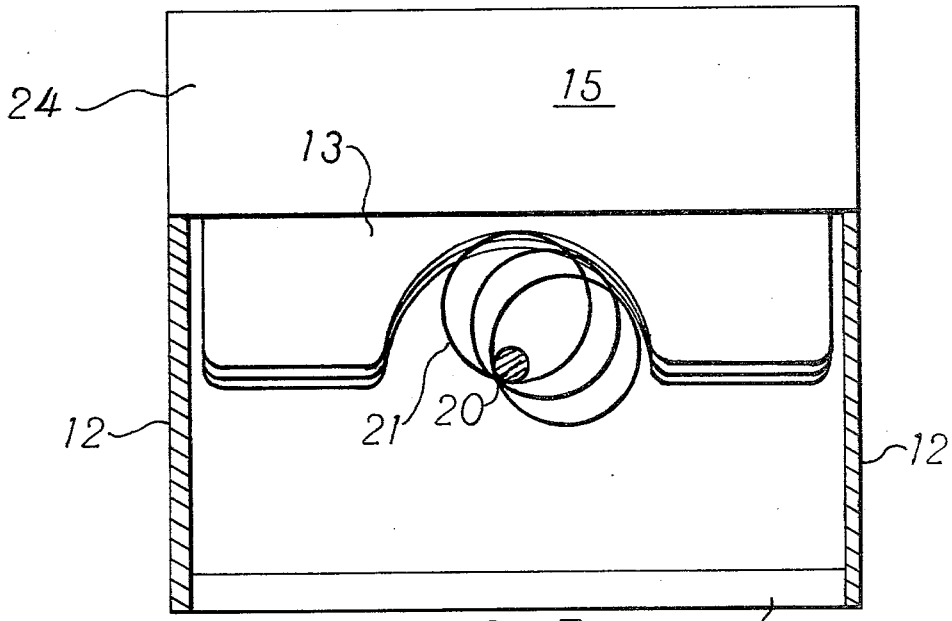
FIG. 3 is a view taken along line 3—3 of FIG. 2.

As shown in the drawings, one form of the novel muscle manipulation apparatus of the present invention includes a frame 11 having a pair of spaced end members 12. The end members 12 are disposed substantially parallel to each other. Since the form of the apparatus of the invention is shown in the drawings as a leg muscle manipulating apparatus, end members 12 are disposed in a vertical position and cut in a configuration which provides in combination with crossmembers 13 extending therebetween, a knee-supporting portion 14, a lower leg-supporting portion 15 and a foot-supporting portion 16. The end members 12 are joined by transverse supports 17 to form the frame 11.

A plurality of the crossmembers or slats 13 extend between the end members 12 adjacent the knee-supporting portion 14 and the leg-supporting portion 15. Crossmembers 13 are disposed in a parallel relationship adjoining each other to form a substantially continuous surface which supports the knee and lower leg of the individual utilizing the apparatus.

Each of the crossmembers 13 is supported for movement in a longitudinal plane through the crossmember which is substantially perpendicular to its portion of the continuous surface formed by the crossmembers. Although the surface may have curves and/or undulations, the adjacent faces of the adjoining crossmembers advantageously are smooth and flat so that adjoining crossmembers can serve as guides during the movement of each crossmember. Alternatively, other guides may be utilized such as brackets (not shown) secured to end members 12 and engaging the ends of the individual crossmembers 13.

Movement of each crossmember 13 along its perpendicular longitudinal plane is achieved by activating means mounted behind the continuous surface formed by the crossmembers. As shown, the activating means includes a rotatable cam shaft 20 positioned behind the crossmembers, that is, on the opposite side of the crossmembers from that forming the continuous surface. Cam shaft 20 is disposed substantially perpendicular to the longitudinal axes of the crossmembers 13. The cam shaft 20 has a plurality of cam surfaces 21 which are equal in number to the crossmembers 13. This construction provides an individual cam surface adjacent to each crossmember.

Drive means shown as an electric motor 22 is provided for rotating cam shaft 20. Cam shaft 20 may be driven directly by motor 22 or through an arrangement of belts and pulleys, or gears, etc. Advantageously, the cam surfaces 21 of shaft 20 have high points which are displaced from each other in uniform angular increments along the length of the cam shaft. For example, with twelve crossmembers, the twelve corresponding cam surfaces would have their high points displaced at 30° intervals around the circumference of the cam shaft, that is, 30°, 60°, 90°, etc. to 360°.

Preferably, the apparatus of the invention also includes a covering 24 of flexible material such as fabric, plastic film, or the like. Also, as shown in the drawings, the foot portion 16 may include a vibrator 25 such as an electromagnetic vibrator of the type commercially available. Advantageously, motor 22 and vibrator 25 are controlled by switches 26 and 27, respectively, which are connected to a power cord and plug 28. The switches 26 and 27 may be conveniently mounted on one of the end members 12.

In the operation of the muscle manipulating apparatus shown in the drawings, an individual positions the apparatus next to a chair and plugs cord 28 into an electrical outlet (not shown). The individual then sits in the chair and rest his legs on the covering 24 of the crossmembers 13 with his feet against foot portion 16.

The position of the apparatus is adjusted so that the legs rest comfortably on the apparatus. Switches 26 and 27 are activated to start motor 22 and vibrator 25.

As shaft 20 is rotated by motor 22, the cam surfaces 21 of the shaft, move with respect to the underside of the crossmembers 13 causing them to be lifted against the legs in a cyclical sequence. If the high points of the cam surfaces 21 are displaced in uniform angular increments as described above, the rotation of cam shaft 20 at a speed of about 60 rpm will cause the crossmembers to be lifted in wave-like motion which provides a kneading action along the length of the leg muscles.

The kneading action of the apparatus may changed by reversing the motor and/or increasing or decreasing the speed thereof. Also, changing the distance that the crossmembers are lifted will produce a difference in the kneading action. Furthermore, the kneading action can be changed by using cam surfaces 21 of different configurations to provide different lifting periods. Changing the shape of the contact surface of one or more of the crossmembers will affect the kneading action, also. Advantageously, the cam surfaces 21 of the cam shaft 20 are arranged to provide a sine/cosine pattern to the movement of the crossmembers.

The apparatus of the invention may be fabricated from a variety of commercially available materials and components. For example, the crossmembers may be wooden slats, plastic or metal bars and the like. Similarly, the end members 12 and the other parts of the frame 11 may be constructed of the above materials.

The apparatus of the invention can be used in the manipulation of other muscles of the body by changing the placement and arrangement of the crossmembers to provide a configuration to the continuous surface which fits the shape of the muscle or muscles being treated. Also, a cam shaft with cam surfaces arranged in a pattern to provide a cyclical movement to the crossmembers which will produce the appropriate kneading action to the muscle undergoing treatment, can be employed.

The above description and the accompanying drawings show that the present invention provides a novel apparatus which automatically manipulates muscles. The apparatus of the invention provides manipulation of muscles without relying on the skill of masseur and even without the use of hands. Thus, the apparatus can be used by an individual in complete privacy without anyone else in attendance.

Furthermore, the apparatus of the invention provides manipulation of muscles automatically according to a professionally selected pattern or patterns. Also, the apparatus can be readily adapted to provide other patterns of manipulation for other muscle treatment. Another advantage of the apparatus of the invention is its simplicity of operation so it can be used with confidence with only a minimum of instruction without special aptitude or skill.

In addition, the apparatus is simple in design and can be fabricated from commercially available components and materials relatively inexpensively. Moreover, the apparatus can be fabricated in a variety of designs to provide users with a choice of functional and appearance features.

It will be apparent that various modifications can be made in the particular muscle manipulating apparatus described in detail above and shown in the drawings within the scope of the invention. For example, the size and configuration of the various components of the apparatus can be changed or interchanged to meet particular requirements. Also, the apparatus can be fabricated for general purpose use on a number of different muscles or can be designed for use with a particular group of muscles such as the leg muscle manipulating apparatus shown in the drawings. Therefore, the scope of the invention is to be limited only by the following claims.

What is claimed is:

1. Muscle manipulating apparatus including a frame having spaced end members disposed substantially parallel to each other, a plurality of crossmembers extending between said end members, each of said crossmembers having a recess in the undersurface thereof, said crossmembers being disposed in a parallel relationship adjoining each other to form a substantially continuous surface, each of said crossmembers being supported for movement in a longitudinal plane through said crossmember which is substantially perpendicular to its portion of said continuous surface, means for sequentially moving each of said crossmembers including a rotatable cam shaft positioned behind said crossmembers and in direct contact with said recesses in the undersurface of said crossmembers, said cam shaft being disposed substantially perpendicular to the longitudinal axes of said crossmembers, said cam shaft having a plurality of cam surfaces equal in number to that of said crossmembers, each of said cam surfaces being disposed adjacent to one of said crossmembers and engageable therewith, and drive means for rotating said cam shaft and said cam surface thereon to provide cyclical movement of said crossmembers.

2. Muscle manipulating apparatus according to claim 1 wherein said crossmembers are covered with a flexible material.

3. Muscle manipulating apparatus according to claim 1 wherein said longitudinal axes of said crossmembers are substantially horizontal.

4. Muscle manipulating apparatus according to claim 1 wherein the high points of said cam surfaces of said cam shaft are displaced in substantially uniform angular increments along the length of said cam shaft.

5. Muscle manipulating apparatus according to claim 1 wherein said cam surfaces of said cam shaft provide substantially the same displacement of said crossmembers along the length thereof.

6. Muscle manipulating apparatus according to claim 1 including an electromagnetic vibrating source adjacent to said crossmembers.

7. Muscle manipulating apparatus according to claim 1 including switch means for actuating said drive means.

* * * * *